US006240689B1

(12) United States Patent
Haddad et al.

(10) Patent No.: US 6,240,689 B1
(45) Date of Patent: Jun. 5, 2001

(54) UTILITY STANDARD

(75) Inventors: Eric Haddad, East Berlin; William M. Niemier, Hanover, both of PA (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/510,661

(22) Filed: Feb. 22, 2000

(51) Int. Cl.[7] ..... E02D 27/42

(52) U.S. Cl. ..... 52/298; 248/44; 248/74.1; 404/13

(58) Field of Search ..... 52/296, 297, 298; 248/49, 62.7, 671, 678

(56) References Cited

U.S. PATENT DOCUMENTS

| | | | | |
|---|---|---|---|---|
| 357,217 | | 2/1887 | McCallip . | |
| 1,086,346 | * | 2/1914 | Barrick . | |
| 1,095,197 | | 5/1914 | Entenmann . | |
| 3,325,950 | | 6/1967 | Pfaff, Jr. . | |
| 3,335,534 | | 8/1967 | Hester et al. . | |
| 3,343,322 | | 9/1967 | Lurkis et al. . | |
| 3,369,331 | | 2/1968 | Deskey et al. . | |
| 3,385,565 | | 5/1968 | Cuthbert . | |
| 3,400,905 | | 9/1968 | Dusen, Jr. . | |
| 3,410,995 | | 11/1968 | Gray . | |
| 3,563,502 | * | 2/1971 | Dayson | 248/44 |
| 3,671,738 | | 6/1972 | Beachley . | |
| 4,200,906 | | 4/1980 | Santilli . | |
| 4,269,010 | * | 5/1981 | Glass | 52/154 |
| 4,488,696 | * | 12/1984 | Sauber | 248/74.1 |
| 4,617,768 | | 10/1986 | Gebelius . | |
| 5,197,819 | * | 3/1993 | Hughes | 404/13 |
| 5,499,885 | | 3/1996 | Chapman . | |
| 5,504,397 | | 4/1996 | Chien . | |
| 5,625,988 | | 5/1997 | Killick . | |
| 5,704,580 | | 1/1998 | Peery, Jr. . | |
| 5,918,849 | * | 7/1999 | Bliss | 248/523 |
| 5,954,426 | | 9/1999 | Whittington . | |

* cited by examiner

*Primary Examiner*—Carl D. Friedman
*Assistant Examiner*—Steve Varner
(74) *Attorney, Agent, or Firm*—Middleton Reutlinger; Jeffrey A. Haeberlin

(57) ABSTRACT

A utility standard assembly having a tubular post member which is circumscribed and compressively held at its base end by a clamp member. The clamp member and tubular member assembly are the received into a clamp receiving pocket in a modular, structural base member which supports the assembly without welding. Wiring opening are located on the bottom of the base member and in the clamp receiving pocket so that the utility wiring may pass from the mounting surface directly into the tubular member. Further, the clamp receiving pocket is supported on legs which create an integral wiring access opening for installation and maintenance. A decorative, wrap-around base cover may be utilized to provide the desired aesthetic effects for the utility standard assembly.

20 Claims, 9 Drawing Sheets

UTILITY STANDARD

BACKGROUND OF THE INVENTION

This invention relates to utility standards having decorative bases, such as area lighting posts, and more particularly relates to a modular structural utility standard assembly with decorative wrap-around base covers.

Presently, utility standards are manufactured with shafts welded to large, heavy decorative but structural base castings. These assemblies are costly, non-modular, and are often damaged in shipping. Additionally, they have weaknesses inherent to their design.

It is well known that the heat associated with welding weakens material at the heat-affected zone. Thus, post-bases, posts, or the welds themselves often fail at the heat-affected zone.

Access to electrical wiring is necessary for installation and maintenance of electrical equipment supported by utility standards, and is typically accomplished by cutting a hole, called a hand-hole, into the shaft near the base. Thus, the shaft is structurally weakened at this point of the shaft.

The geometry of aesthetically-pleasing base castings is generally not shaped as necessary for maximizing strength. Sharp corners and decorative indentations, while architecturally stylish, create structural weaknesses and failure points.

An additional disadvantage to utility standards of the present art is that bases having various shaped and sized post openings are required to accommodate shafts of different shapes and sizes. Such varying shafts are required for various strength and appearance purposes. Common shapes and sizes include posts with circular, polygonal, or fluted cross-sections from 3 to 5 inches across. Thus, there is no interchangeability between posts and bases having differing sizes and shapes.

One present attempt to address these problems involves threading a shaft and post base. However, it is readily apparent that such a design is difficult to install. Further, each different size of shaft continues to require a different base, and only cylindrical shafts can be used.

Another attempt to address the problems is described in U.S. Pat. No. 5,499,885 to Chapman. Chapman discloses a method and apparatus for joining a tubular component to another component, such as a base plate, without welding through the use of a joining device nested inside of the passageway, which is then expanded to engage the wall of the passageway. This device, however, involves numerous components, is difficult to assemble in the field, and still lacks easy wiring access.

SUMMARY OF THE INVENTION

The utility standard assembly of the present invention addresses the problems described through the use of a modular structural post-base and a clamp mechanism which attaches to the post without welding. Wire access is integral to the base, eliminating the need for hand-holes in the post. The post-base mounts to the ground or other surface with anchor rods/bolts. The clamp mechanism is customized to accommodate a variety of post shapes and sizes while still mating with a standard post-base. The clamp may be attached to the post at the factory. The base may be shipped separately from the post and pre-installed in the field, since it is a standard part. Then, the clamp-post assembly may be easily secured to the post-base in the field without welding. This allows the design to be completely modular, unlikely to be damaged during shipping, and very strong because of its lack of weld joints, hand-holes, or need for aesthetically pleasing structure. A decorative, wrap-around base may be added after assembly of the base, clamp and post.

Thus, it is an object of the present invention to provide a modular structural post-base with wrap-around base covers for aesthetics.

It is another object of the present invention to provide wire access which is integral to the base, thus eliminating the need for hand holes in the shaft.

It is another object of the present invention to provide a clamp mechanism which attaches securely to the shaft which can be mechanically held by the base without the need for welding.

It is a further object of the present invention to provide clamps which will have different inside diameters and shapes to accommodate a variety of shaft sizes and shapes for use with a single, modular base.

It is another object of the present invention to provide a utility standard with has a decorative, wrap around base.

More particularly, the present invention provides a utility standard having a base member which has a clamp receiving pocket supported by a leg or legs which have a wiring access opening. The clamp receiving pocket also has a pocket wall and a wiring opening. A tubular member is circumscribed and compressively held at its base end by a clamp member, which is received by the clamp receiving pocket to create a modular, structural utility standard capable of being assembled without welding.

DETAILED DESCRIPTION OF THE PREFERRED EMBODIMENT

Figure 1:
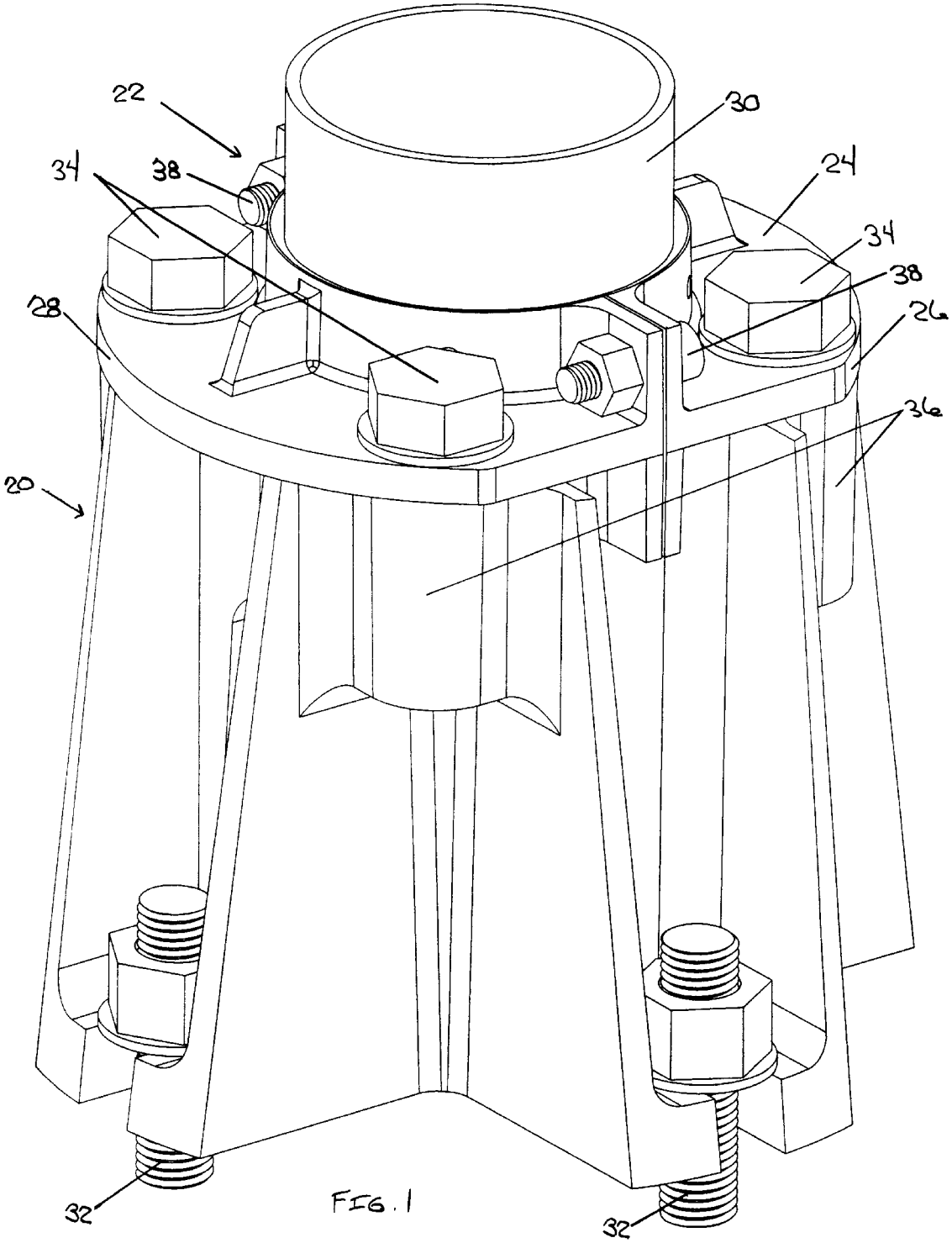
FIG. 1 is a perspective view of assembled base, clamp and post members of the assembly of the present invention.

The preferred embodiment of the present invention, as shown in FIG. 1, comprises a one-piece base member 20 to which a post-clamp assembly 22 is attached. A clamp member 24 is comprised of two sections 26, 28 which clamp around a tubular member 30, and which are then attached to the base member 20.

As also shown in FIG. 1, the base member 20 of the preferred embodiment is a high strength one piece casting, that mounts, like existing utility standard bases, with anchor rods 32. The clamp member 24 attaches securely to the base member 20 without welding through the use of base bolts 34 into structural clamp support ears 36 of the base member 20. The clamp member 24 also attaches securely to the tubular member 30 by bolting the sections 26, 28 together.

Figure 2:
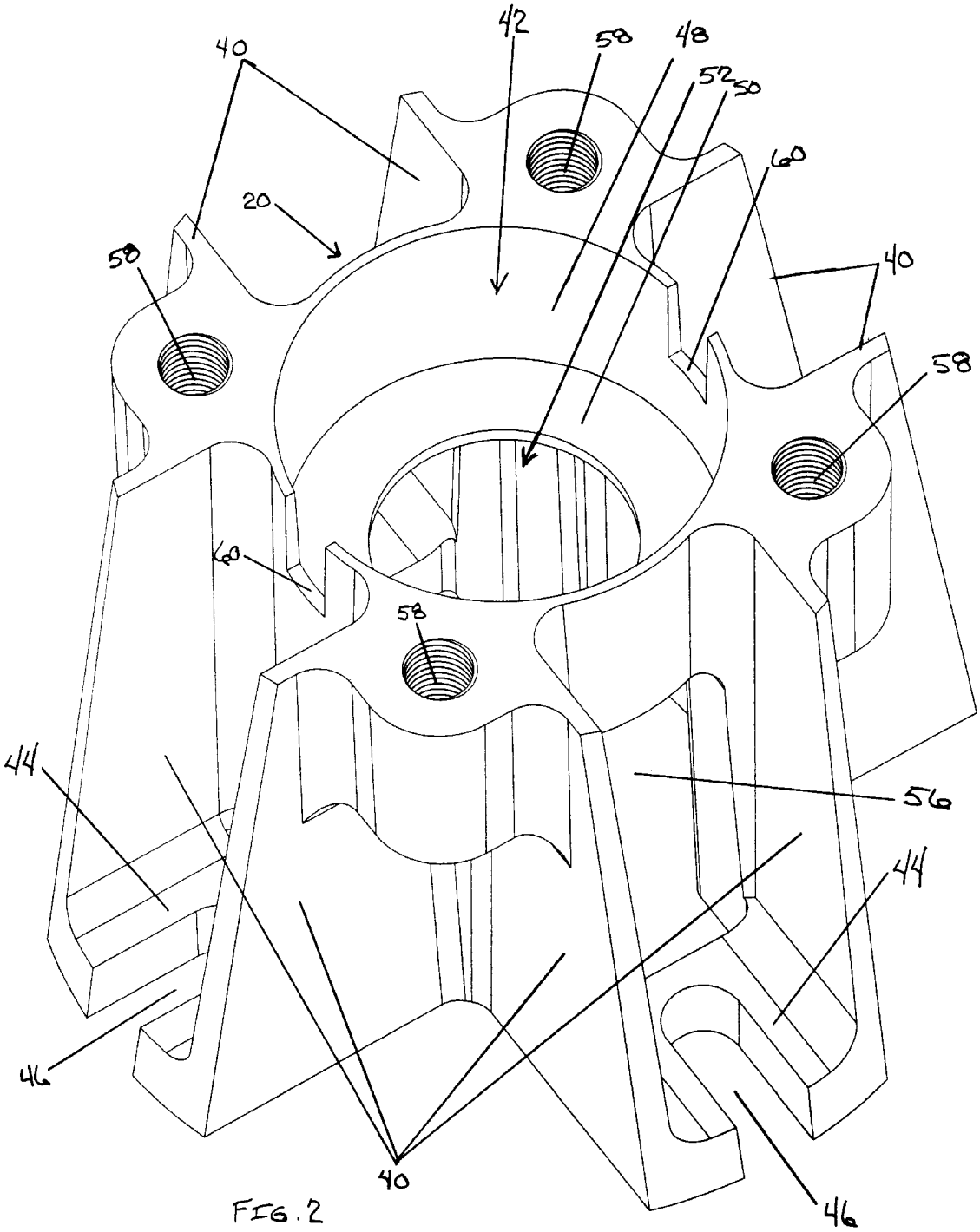
FIG. 2 is a perspective view of the base member of the assembly of FIG. 1.
Figure 6:
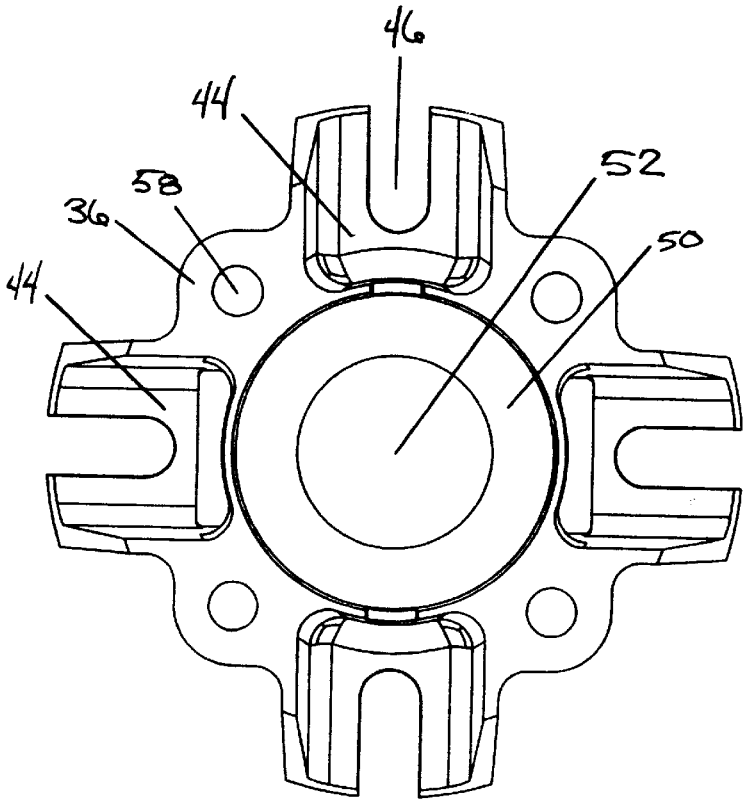
FIG. 6 is a top view of the base of the assembly of FIG. 1.

As shown in FIG. 2, the base member 20 of the preferred embodiment has eight legs 40 supporting a clamp receiving pocket 42 above the ground. The top of the base is approximately 9 ⅜ inches above the ground. When viewed from above, as seen in FIG. 6, the legs are arranged in a number-sign, or tic-tac-toe shaped pattern, and taper in width from the bottom to the top of the base member 20. Further, the legs 42 taper in thickness from ⅜ inch at the bottom to ½ inch at the top of the base member 20. This arrangement provides strength with an efficient use of materials.

The preferred embodiment base member 20 is cast of an aluminum alloy. However, it is noted that the base member 20 could also be cast of a wide range of materials, such as brass, stainless steel, or iron.

Also shown in FIG. 2, the base member 20 has four feet 44 formed between matched pairs of legs 40. The feet are approximately 1 inch thick and contain anchor rod slots 46 for mounting base member 20 to a surface such as a sidewalk, street or parking lot. The slots 46 are open-ended to provide a degree of tolerance for placement of the anchor rods 32, and are sized to accept 1 inch diameter anchor rods 32. The feet 44 also tie adjacent parallel legs 40 together at the bottom of the legs 40 to provide added strength and stability to the base member 20.

The clamp receiving pocket 42 ties the legs 40 together at the top of the legs 40 and is formed of a cylindrical pocket wall 48 and an annular ring 50 along the bottom edge of the pocket wall 48. The annular ring 50 further adds structural stability to the base member 20. A wiring opening 52 is defined by the annular ring 50 which allows wiring for the utility standard to enter the tubular member 30 at its open base end.

Figure 7:
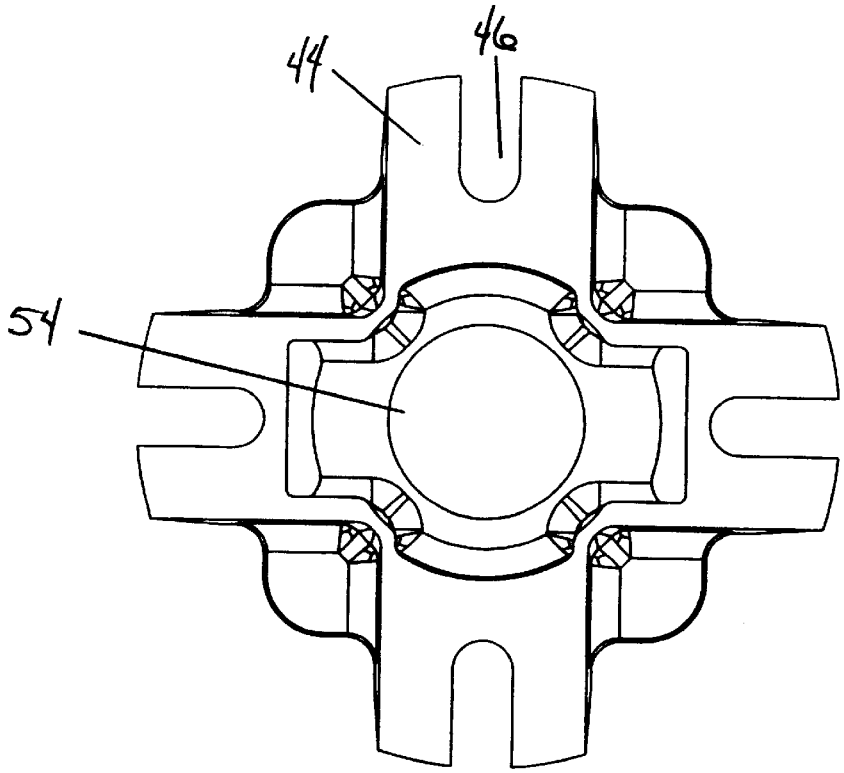
FIG. 7 is a bottom view of the base of the assembly of FIG. 1.

As shown in FIG. 7 the legs 40 and feet 44 of the base member 20 form a bottom opening 54 through which wiring may pass from the mounting surface into the base member 20 and tubular member 30.

As shown in FIG. 2, also formed by the base member legs 40 is a wiring access opening 56 into the center portion of the base member 20 for installation and maintenance of the wiring components of the utility standard. Thus, wiring access to the utility standard is completely accessible without having to cut any access holes in the tubular member 30 whatsoever.

Still referencing FIG. 2, four clamp support ears 36 are formed at the top of the base member 20 in the area between adjacent intersecting legs 40. These ears 36 are heavily blended into the legs 40 and the pocket wall 48, and a threaded bolt receiving hole 58 is machined into each ear 36. Each ear 36 is approximately 3 inches high, and each bolt receiving hole 58 is threaded to receive a 1 inch diameter bolt.

In order in make the base member 20 easier to cast, the clamp receiving pocket 42 itself tapers from slightly larger than 5 ⅝ inches at the top to slightly less than 5 ½ inches at the bottom. The pocket 42 is approximately 2 ⅞ inches deep. Clamp guiding slots 60 are cut into opposing sides of the pocket wall 48 to allow room for a vertical flange 62 on the clamp member 24, and to guide the clamp member 24 into the clamp receiving pocket 42.

Figure 3:
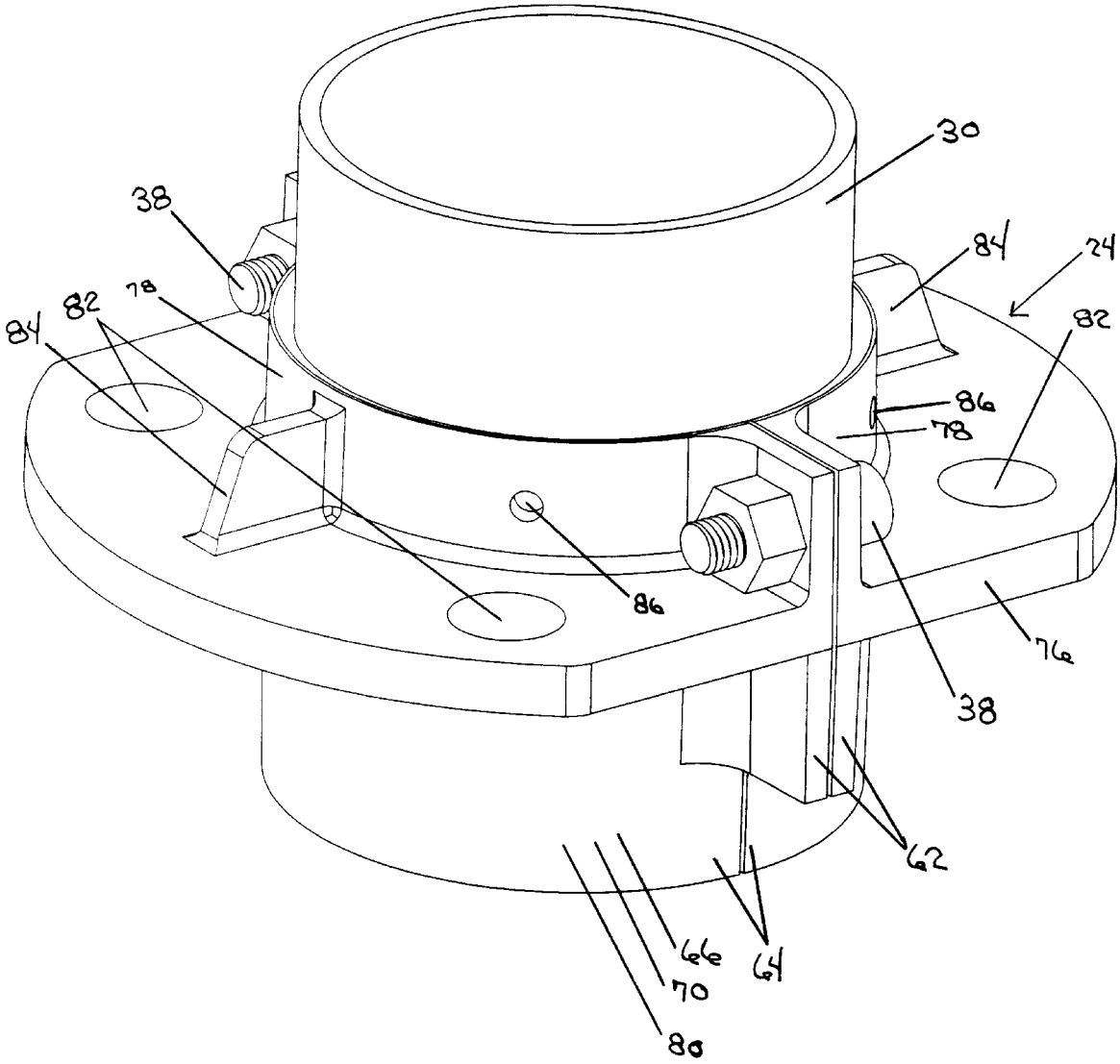
FIG. 3 is a perspective view of assembled clamp and post members of he assembly of FIG. 1.
Figure 4:
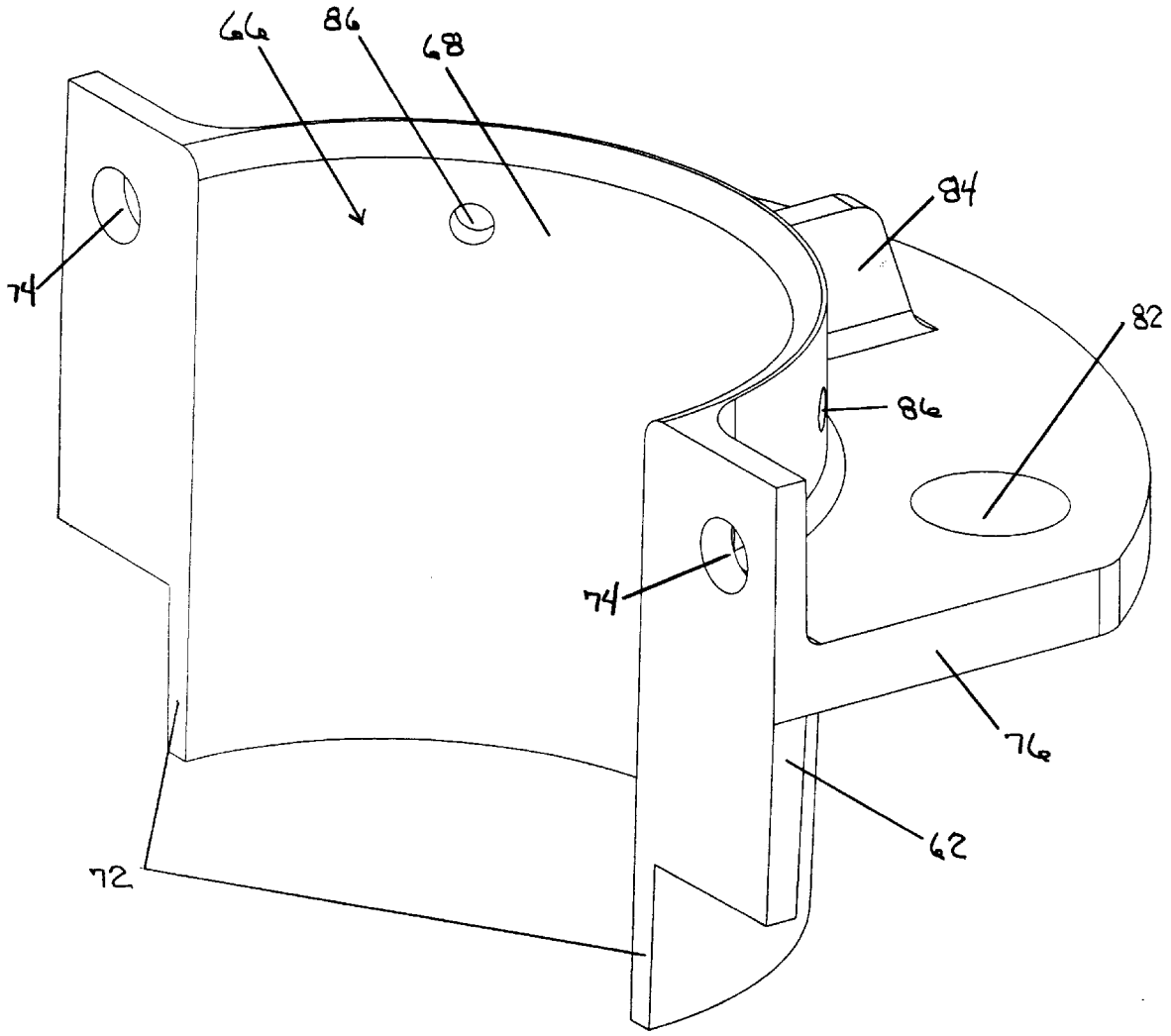
FIG 4 is a perspective view of a clamp section of the assembly of FIG. 1, viewed from the interior wall side of the clamp.
Figure 5:
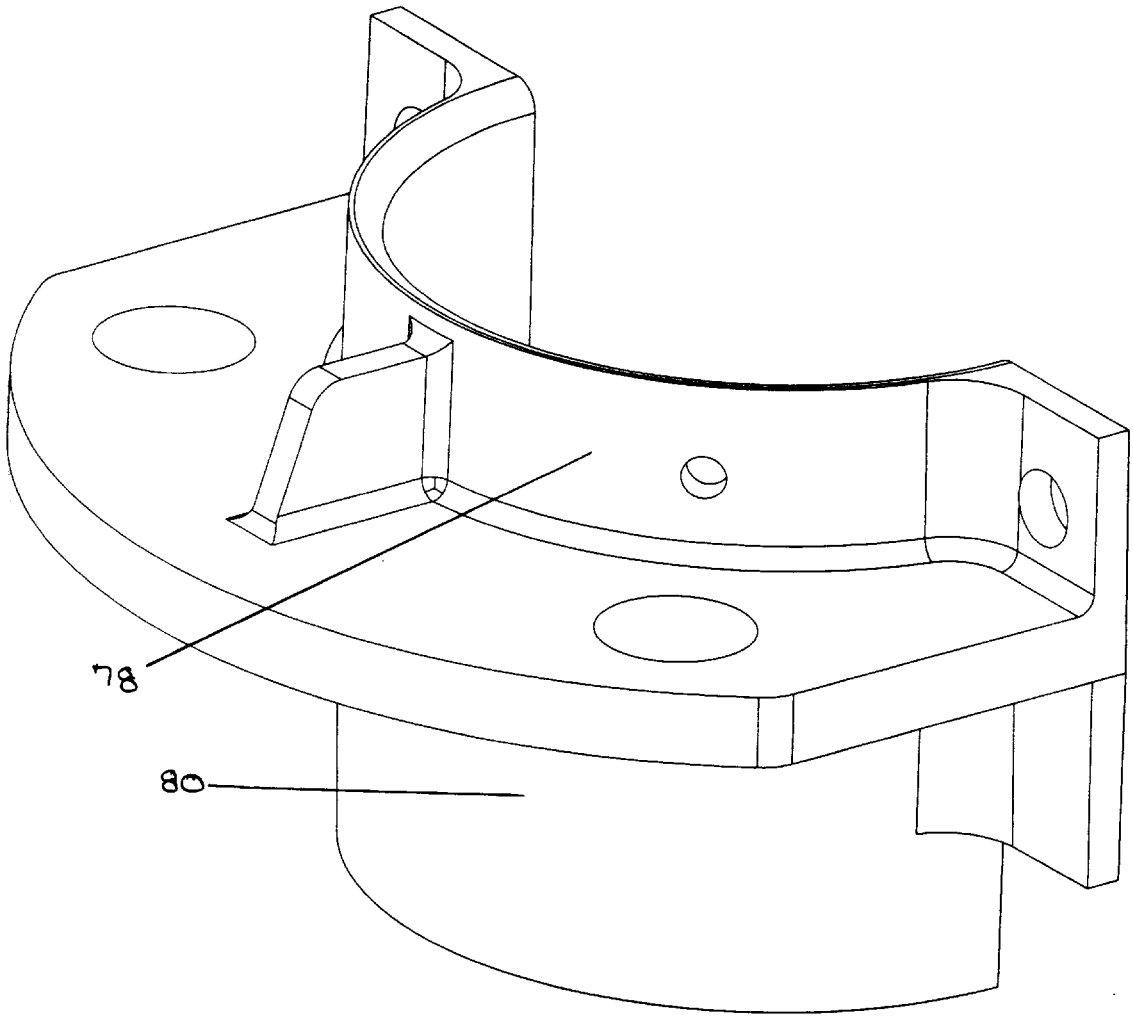
FIG. 5 is also a perspective view of a clamp section of the assembly of FIG. 1, viewed from the flange side of the clamp.

The clamp member 24 of the preferred embodiment, as shown in FIG. 3 through FIG. 5, is comprised of two symmetrical sections 26, 28, which, when placed together, form a complete collar 64. Thus, each section has a collar portion 66. Each collar portion 66 has an interior wall 68 which is shaped to mate with the tubular member 30 and is slightly smaller in diameter than the diameter of the tubular member 30, and an exterior wall 70 which is shaped to mate with the pocket wall 48 of the base member 20. The exterior wall 70 of each clamp section 26, 28 is slightly smaller than the diameter at the bottom of the clamp receiving pocket 42.

Additionally, the clamp sections 26, 28 of the preferred embodiment are formed with a vertical flange 62 at the side edge 72 of each section. The vertical flanges 62 have aligning clamp bolt holes 74. Thus, assembly and compression of the clamp sections 26, 28 around the tubular member 30 is accomplished by bolting the sections 26, 28 together through the clamp bolt holes 74 in the vertical flanges 62.

Figure 8:
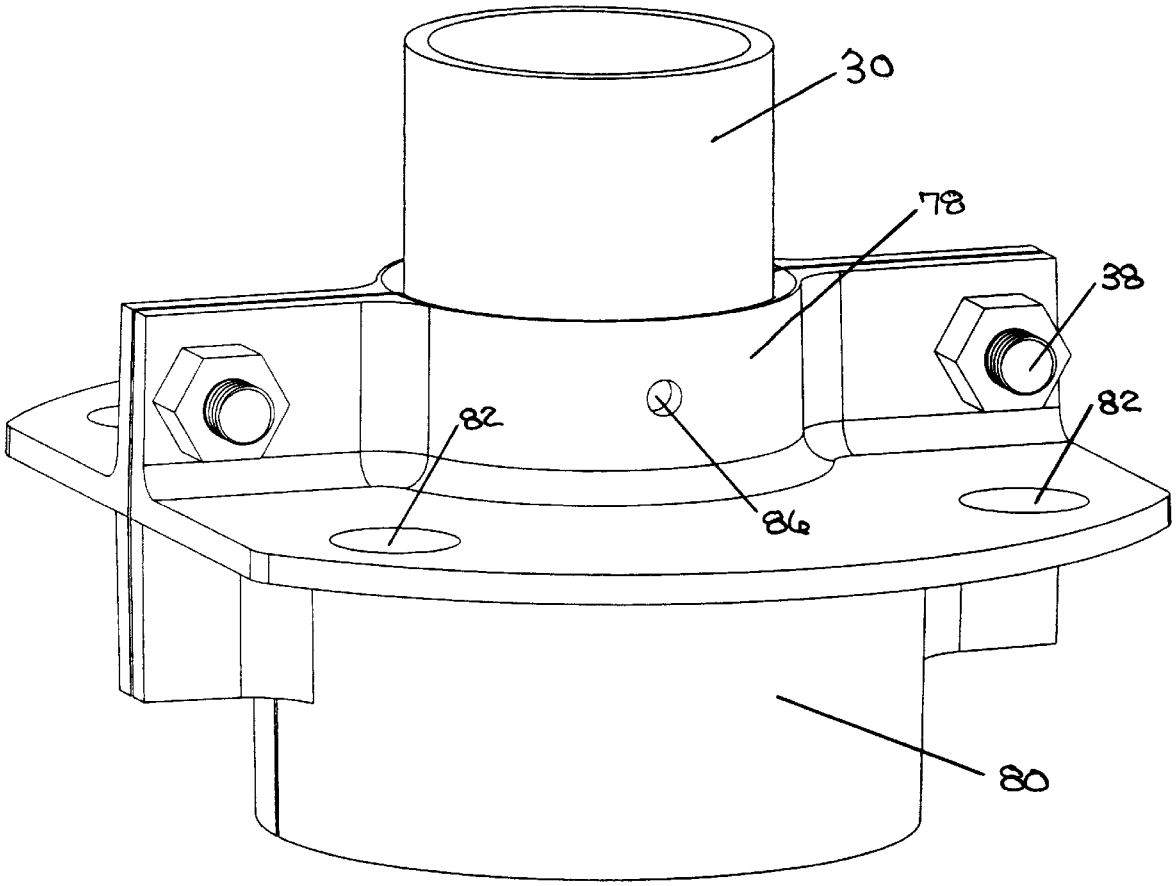
FIG. 8 is a perspective view of assembled clamp and post member of the device of the present invention illustrating a clamp designed for use with a post having a smaller diameter than the post of the assembly of FIG. 1.

Further, the clamp sections 26, 28 of the preferred embodiment are formed with a horizontal flange 76 along the exterior wall 70 which defines an upper portion 78 and a lower portion 80 of the exterior wall 70. This allows the lower portion 80 of the exterior wall 70 to nest in the clamp receiving pocket 42. Horizontal flange 76 has bolt holes 82 which align with the bolt receiving holes 58 in the clamp support ears 36 and allow the clamp member 24 to be bolted onto the base member 20. Further, as shown in FIG. 8, the horizontal flange 76 allows for the upper portion 78 to have a thinner construction when the clamp is used for a smaller diameter tubular member 30', while allowing the lower portion 80 to continue to mate with the clamp receiving pocket 42 of the base member 20.

Additionally, the preferred embodiment when used with larger diameter tubular members, ie. a five inch diameter post, utilizes gusset plates 82 between the horizontal flange 76 and the upper portion 78 of the exterior wall 70, placed 90 degrees from the vertical flanges 62. Together with the vertical flanges 62, the gusset plates 84 provide additional support against cyclical fatigue force exerted on the exterior wall 70 by the action of wind on the tubular member 30. Further stabilization of the tubular member 30 may be obtained through the use of set screws (not shown) against the post through set screw holes 86 threaded through the collar 64.

Figure 9:
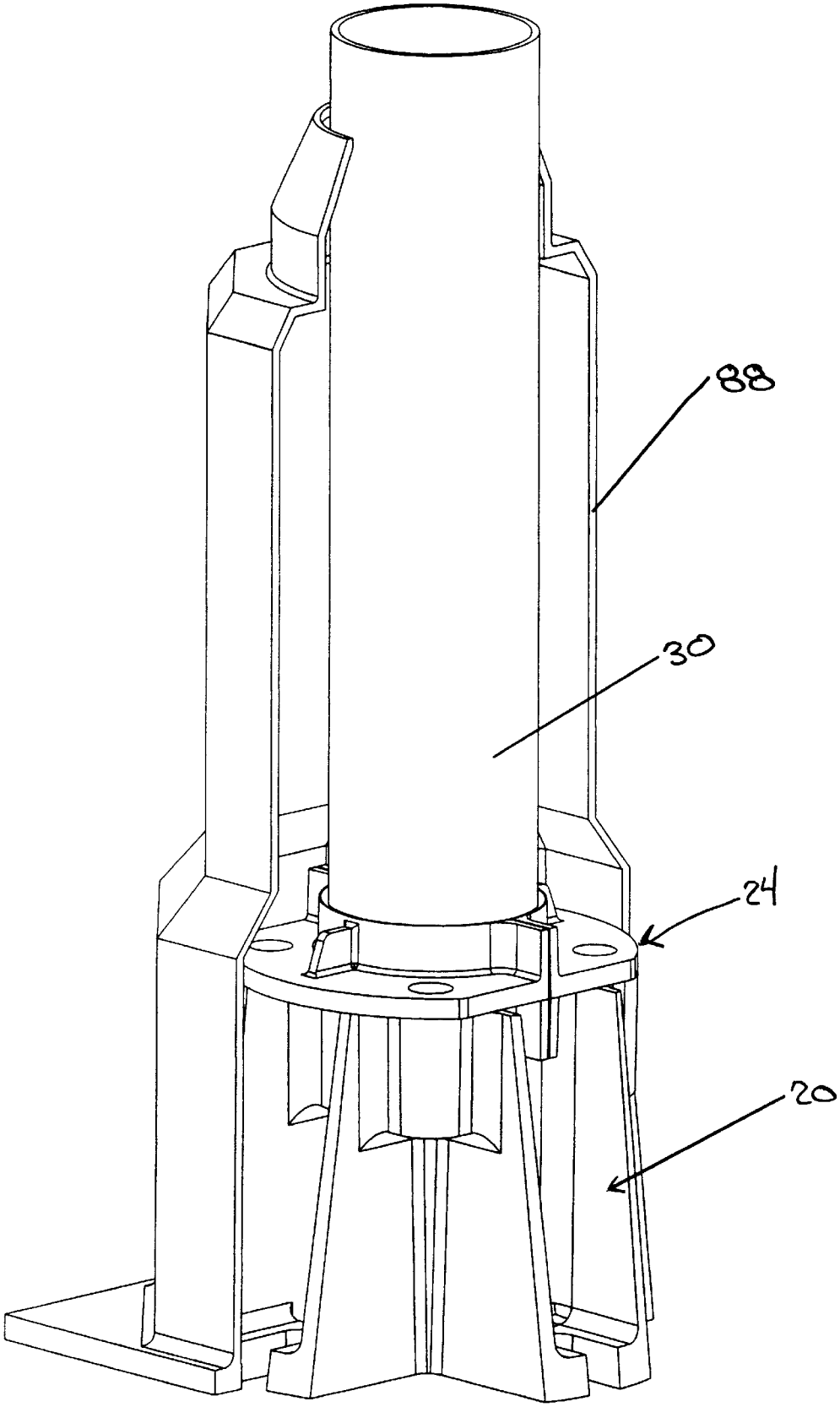
FIG. 9 is a perspective view of the assembly of FIG. 1 together with a decorative wrap-around base section.
Figure 10:
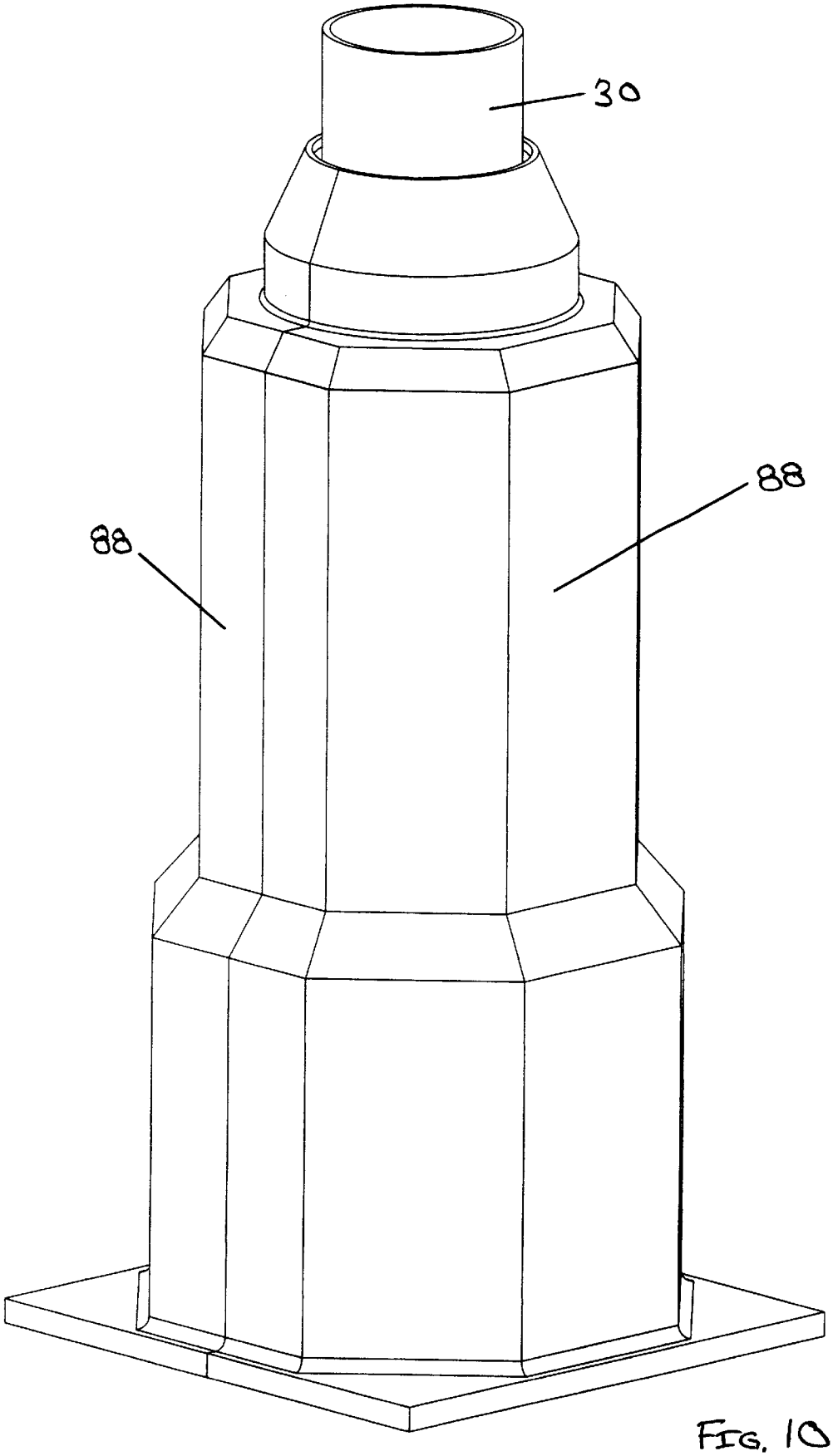
FIG. 10 is a perspective view of the assembly of FIG. 1 together with a decorative wrap-around base completely installed around the assembly of FIG. 1.

Lastly, FIG. 9 and FIG. 10 show the addition of a decorative, wrap-around base 88 to the utility standard assembly to create an aesthetically and architecturally pleasing utility standard with a decorative base without the problems inherent in such utility standards of the present art.

This detailed description, and particularly the detailed measurements of the preferred embodiment, is given primarily for clearness of understanding and no unnecessary limitations are to be understood therefrom for modifications will become obvious to those skilled in the art upon reading this disclosure and may be made without departing from the spirit of the present invention and scope of the appended claims.

What is claimed is:

1. A utility standard comprising:

a. a base member comprising one or more legs having a wiring access opening, and a clamp receiving pocket supported by said legs, said clamp receiving pocket having a pocket wall and a wiring opening;

b. a clamp member received by said clamp receiving pocket; and c. a tubular member having a base end, said tubular member being circumscribed and compressively held at said base end by said clamp member.

2. The utility standard according to claim 1 wherein said base member further comprises a plurality of feet located at the base of said legs, each foot having an anchor bolt slot.

3. The utility standard according to claim 1, said clamp member including at least two connected sections wherein each clamp member section has a collar portion, said collar portion comprising:

a. an interior wall, said interior wall shaped to mate with said tubular member;

b. an exterior wall, said exterior wall shaped to mate with said clamp receiving pocket; and c. side edges.

4. The utility standard according to claim 3 wherein each clamp member section further has a vertical flange formed at each side edge.

5. The utility standard according to claim 4 wherein said clamp member sections are connected by bolting the sections together through clamp bolt holes formed in said vertical flanges.

6. The utility standard according to claim 4 wherein said pocket wall has a clamp guiding slot which receives and guides clamp member vertical flange.

7. The utility standard according to claim 3 wherein the clamp member is attached to the base member.

8. The utility standard according to claim 7 wherein each clamp member section further has a horizontal flange formed along the exterior wall of the collar, said horizontal flange further defining:

a. a upper portion of the exterior wall located between the horizontal flange and the top edge of the collar, and b. a lower portion of the exterior wall located between the horizontal flange and the bottom edge of the collar.

9. The utility standard according to claim 8 wherein base member further comprises a plurality of clamp support ears formed adjacent to the clamp receiving pocket, said ears having bolt receiving holes.

10. The utility standard according to claim 9 wherein the clamp member is bolted to the base member through a plurality of bolt holes in said horizontal flange into bolt receiving holes in base member ears.

11. The utility standard according to claim 8 wherein each said section further has at least one gusset plate between the horizontal flange and the exterior wall upper portion.

12. A utility standard according to claim 1 wherein each clamp member section further comprises:

a. an arcuate horizontal flange;

b. a collar portion formed inside said horizontal flange, said collar portion comprising:

i. a top edge;

ii. a bottom edge;

iii. an exterior wall lower portion located between the horizontal flange and the bottom edge of the collar, said exterior wall lower portion shaped to mate with said clamp receiving pocket;

iv. an exterior wall upper portion located between the horizontal flange and the top edge of the collar; and v. an interior wall, said interior wall shaped to mate with said tubular element.

13. The utility standard according to claim 12 wherein each clamp member section further has a vertical flange formed at each side edge.

14. The utility standard according to claim 13 wherein said clamp member sections are connected by bolting the sections together through bolt holes formed in said vertical flanges.

15. The utility standard according to claim 12 wherein the clamp member is attached to the base member.

16. The utility standard according to claim 15 wherein base member further comprises a plurality of clamp support ears formed adjacent to the clamp receiving pocket, said ears having bolt receiving holes.

17. A utility standard comprising:

a base member comprising:

one or more legs having a wiring access opening;

a clamp receiving pocket supported by said legs, said clamp receiving pocket having a pocket wall and a wiring opening;

a plurality of clamp support ears formed adjacent to the clamp receiving pocket, said ears having bolt receiving holes;

a clamp member received by said clamp receiving pocket, said clamp member having:

an arcuate horizontal flange;

a collar portion formed inside said horizontal flange, said collar portion comprising:

a top edge;

a bottom edge;

an exterior wall lower portion located between the horizontal flange and the bottom edge of the collar, said exterior wall lower portion shaped to mate with said clamp receiving pocket;

an exterior wall upper portion located between the horizontal flange and the top edge of the collar;

an interior wall, said interior wall shared to mate with said tubular element; and a tubular member having a base end, said tubular member being circumscribed and compressively held at said base end by said clamp member;

said clamp member being bolted to said base member through a plurality of bolt holes in said horizontal flange into said bolt receiving holes in said clamp support ears.

18. The utility standard according to claim 12 wherein each said section further has at least one gusset plate between the horizontal flange and the exterior wall upper portion.

19. The utility standard according to claim 1 further comprising decorative, wrap-around base covers.

20. The utility standard according to claim 1 wherein said base member is an one piece casting.

* * * * *